US007364465B2

(12) United States Patent
Wu

(10) Patent No.: US 7,364,465 B2
(45) Date of Patent: Apr. 29, 2008

(54) PLUG CONNECTOR WITH IMPROVED STRAIN RELIEF MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/509,101

(22) Filed: Aug. 24, 2006

(65) Prior Publication Data

US 2007/0037437 A1 Feb. 15, 2007

Related U.S. Application Data

(63) Continuation-in-part of application No. 11/201,521, filed on Aug. 11, 2005, now Pat. No. 7,114,980.

(51) Int. Cl.
*H01R 9/03* (2006.01)

(52) U.S. Cl. ..... 439/610; 439/76.1

(58) Field of Classification Search ..... 439/610, 439/98, 99, 76.1

See application file for complete search history.

(56) References Cited

U.S. PATENT DOCUMENTS 4,887,971 A * 12/1989 Reuss et al. ..... 439/98
6,869,308 B2 3/2005 Wu
6,887,091 B1 5/2005 Wu
2006/0019525 A1 1/2006 Lioyd et al.
2006/0040556 A1 2/2006 Neer et al.

OTHER PUBLICATIONS

"SFF-8088 Specification for Compact Multilane Series: Shielded" published on Jun. 27, 2005 by SFF Committee.

* cited by examiner

*Primary Examiner*—Ross Gushi
(74) *Attorney, Agent, or Firm*—Wei Te Chung

(57) ABSTRACT

A plug connector (100) includes a housing (1), a PCB (2) received in the housing, a cable set (7) electrically connecting with the PCB, a pulling member (32) moveable relative to the housing in a horizontal direction, a latch member (31) discrete from the pulling member and assembled to the housing for latch with a complementary connector, and a pull tape (33) discrete from the pulling member and assembled to the pulling member. The cable set includes a plurality of conductors (73, 74) connecting with the PCB, a metal braiding layer (72) forming a space and an outer jacket surrounding the metal braiding layer. A strain relief member (8) is assembled to the cable set and surrounded by the metal braiding layer.

20 Claims, 8 Drawing Sheets

PLUG CONNECTOR WITH IMPROVED STRAIN RELIEF MEMBER

CROSS-REFERENCE TO RELATED APPLICATIONS

The present invention is a CIP (continuation-in-part) of U.S. patent application Ser. No. 11/201,521 filed on Aug. 11, 2005 now U.S. Pat. No. 7,114,980. Furthermore, t his application is related to U.S. patent application Ser. No. 11/201,521 filed on Aug. 11, 2005 and entitled "CABLE CONNECTOR ASSEMBLY WITH LATCHING MECHANISM", U.S. patent application Ser. No. 11/201,461 filed on Aug. 11, 2005 and entitled "CABLE CONNECTOR ASSEMBLY WITH LATCHING MECHANISM", U.S. patent application Ser. No. 11/268,906 filed on Nov. 8, 2005 and entitled "CABLE CONNECTOR ASSEMBLY WITH LATCHING MECHANISM", U.S. patent application Ser. No. 11/268,902 filed on Nov. 8, 2005 and entitled "JUXTAPOSED CABLE CONNECTOR ASSEMBLIES", and U.S. patent application Ser. No. 11/322,692 filed on Dec. 30, 2005 and entitled "STACKED CONNECTOR ASSEMBLY", U.S. patent application Ser. No. 11/213,048 filed on Aug. 26, 2005 and entitled "CABLE CONNECTOR ASSEMBLY WITH EMI GASKET", and U.S. patent application Ser. No. 11/481,132 filed on Jul. 3, 2006 and entitled "CABLE CONNECTOR ASSEMBLY WITH LATCHING MECHANISM", all of which have the same applicant and assignee as the present invention. The disclosure of these related applications is incorporated herein by reference.

BACKGROUND OF THE INVENTION

1. Field of the Invention

The present invention generally relates to a plug connector, and more particularly to a plug connector used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products. Specification SFF-8088 defines matable Compact Multilane Shielded connectors adopted for being used in laptop portable computer to connect small-size disk drives to a printed circuit board. The connectors comprise a cable connector assembly connecting with the small-size drive and a header mounted on the printed circuit board. The cable connector assembly defined in the specification comprises a pair of engagble metal housings together defining a receiving space therebetween, a PCB received in the receiving space, a cable comprising a plurality of conductors electrically connecting with the PCB, and a latching mechanism assembled to a top surface of the upper metal housing. The latching mechanism comprises an elongated T-shape latch member for latching with the header mentioned above and a pulling member cooperating with the latch member for actuating the latch member to separate from the header. Commonly, the cable where exits from the metal housings is crimped by a strain relief member which contacts metal braiding layer thereof for providing strain relief to the cable and shielding the signal transmission. However, in some cases, the cable assembly needs a plurality of cables transmitting signals together. Thus, the conventional simple-structure strain relief member is not suitable to use in such case.

Hence, a plug connector with improved strain relief member is provided in the present invention to address the problems mentioned above and meet the current trend.

BRIEF SUMMARY OF THE INVENTION

Accordingly, an object of the present invention is to provide a plug connector with an improved strain relief member to provide enough strain relief to cables thereof.

In order to achieve the above-mentioned object, a plug connector in accordance with the present invention comprises a metal housing, a plurality of conductive contacts located in the metal housing, a cable set comprising a plurality of conductors electrically connecting with the contacts, a metal braiding layer shielding the conductors, and an outer jacket surrounding the metal braiding layer, and a strain relief member assembled to the cable set. The housing defines a receiving channel in a rear portion thereof and an exiting opening communicating with the receiving channel and rear surface of the metal housing. The strain relief member is located between the outer jacket and the metal braiding layer of the cable set and is received in the receiving channel of the meta housing with the metal braiding layer contacting with the metal housing.

Other objects, advantages and novel features of the invention will become more apparent from the following detailed description of the present embodiment when taken in conjunction with the accompanying drawings.

DETAILED DESCRIPTION OF THE INVENTION

Figure 1:
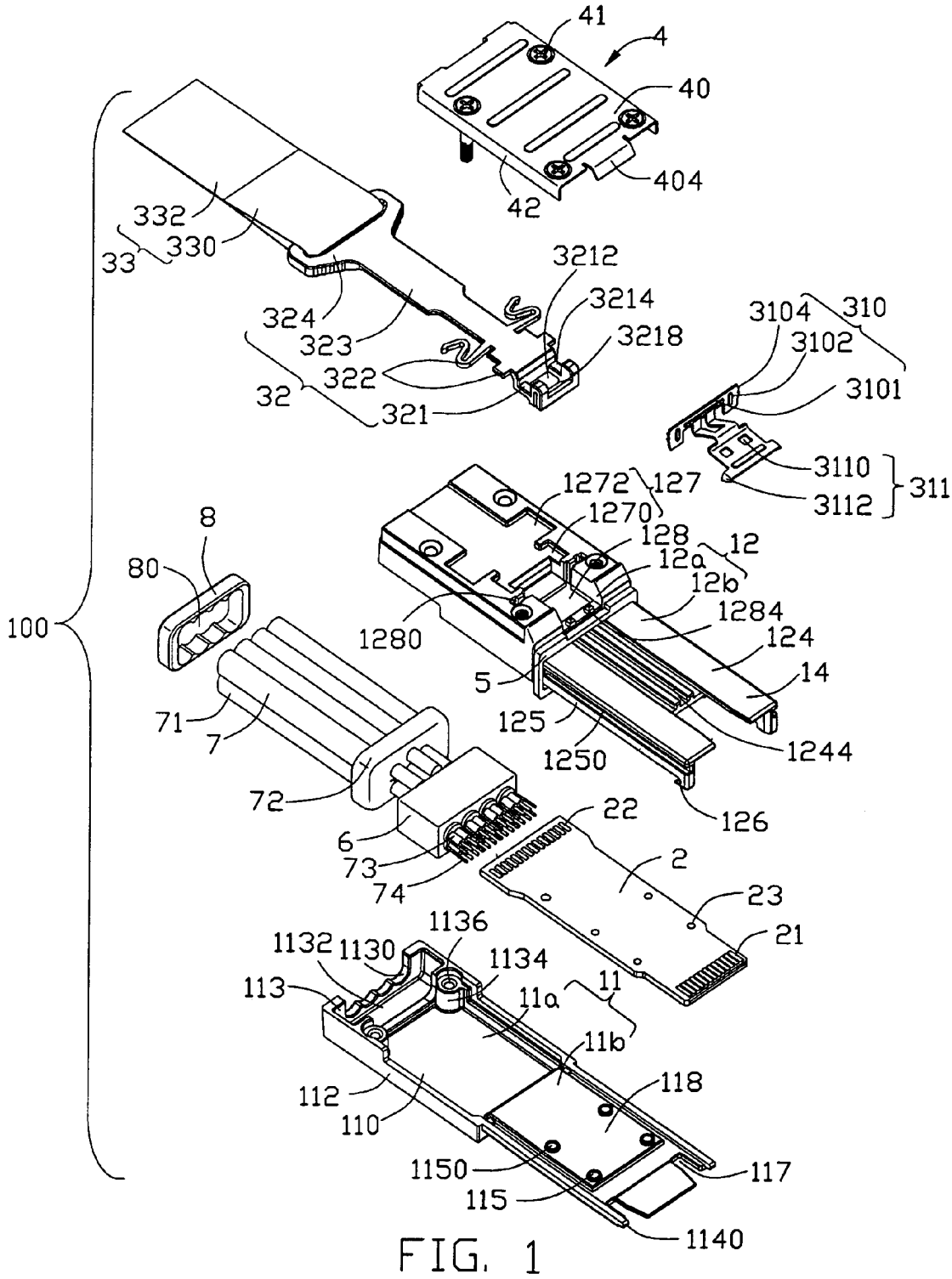
FIG. 1 is an exploded, perspective view of a plug connector in accordance with the present invention.

Reference will now be made to the drawing figures to describe the present invention in detail.

Figure 2:
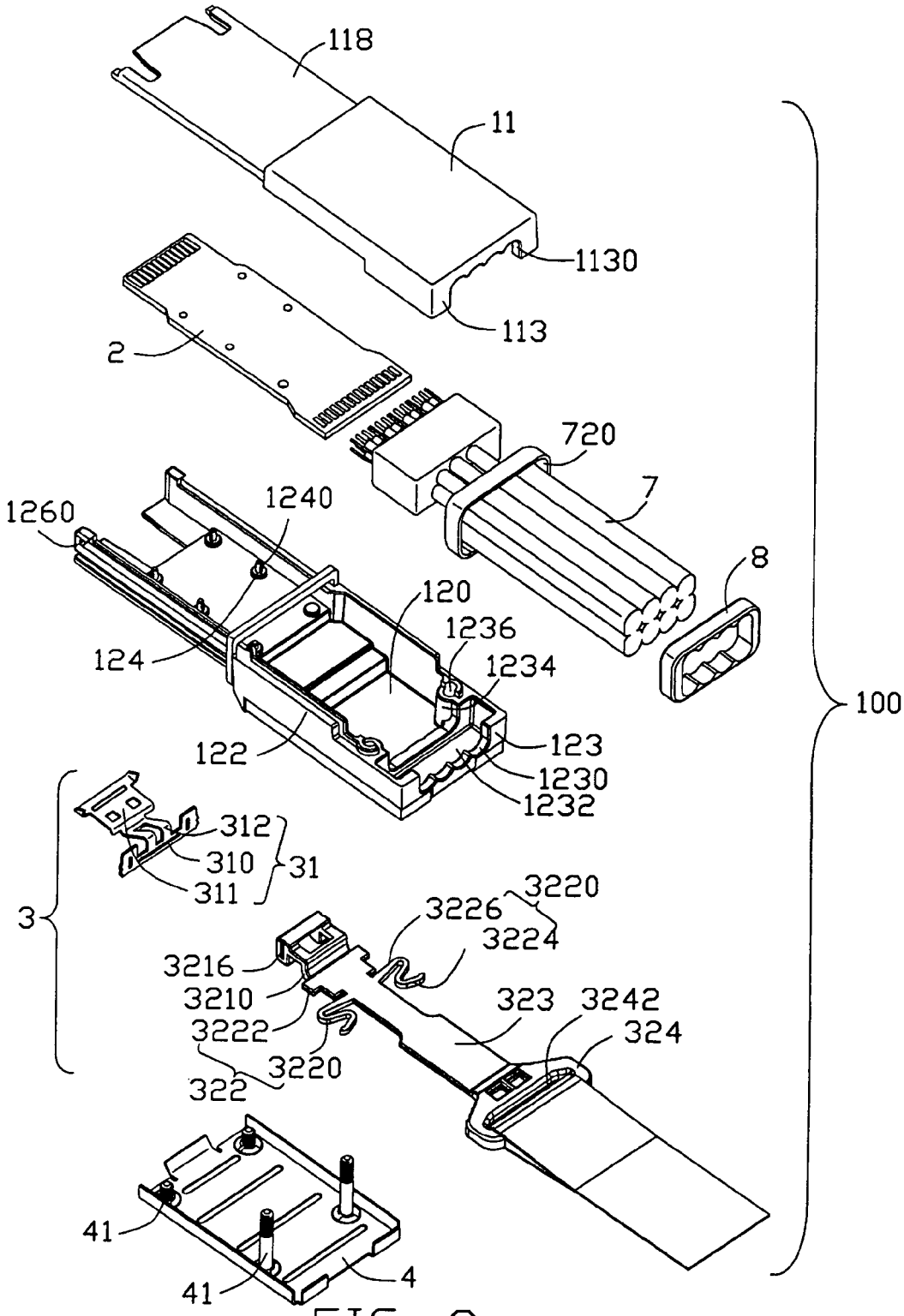
FIG. 2 is a view similar to FIG. 1, but viewed from a different aspect.
Figure 3:
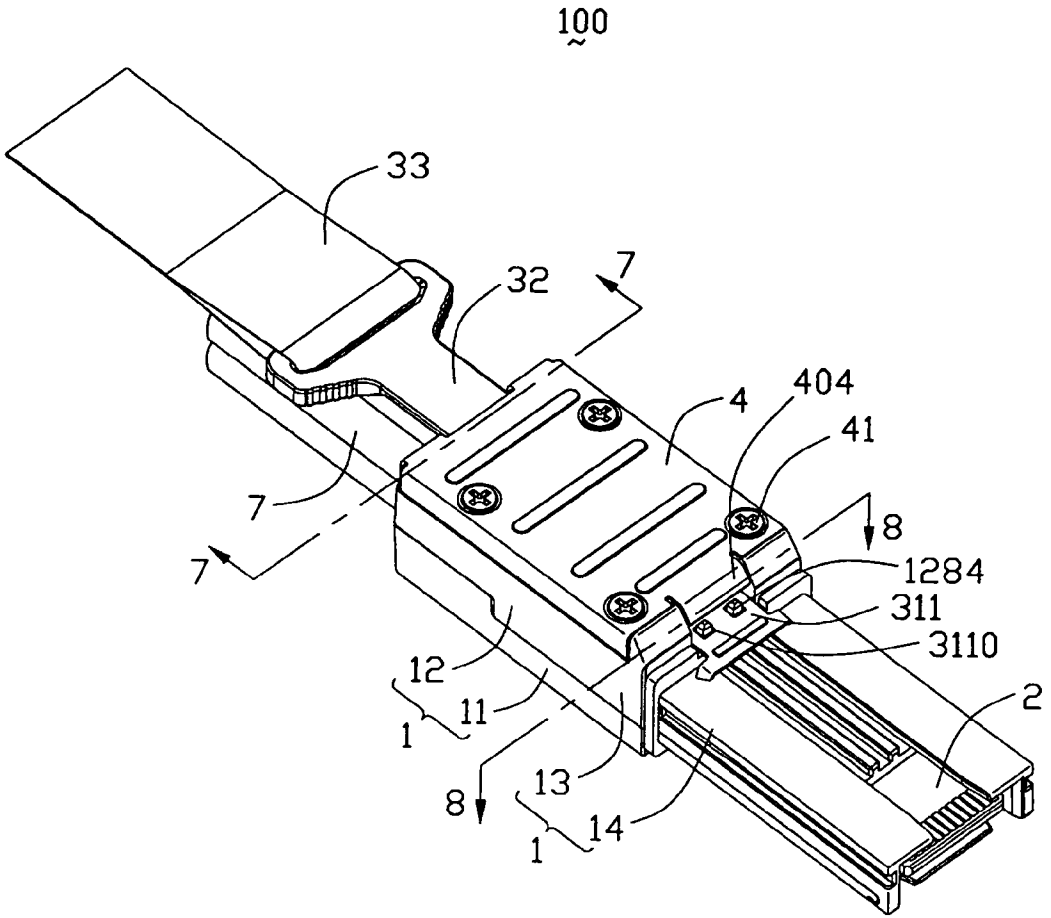
FIG. 3 is an assembled, perspective view of the plug connector of the present invention of FIG. 1.
Figure 4:
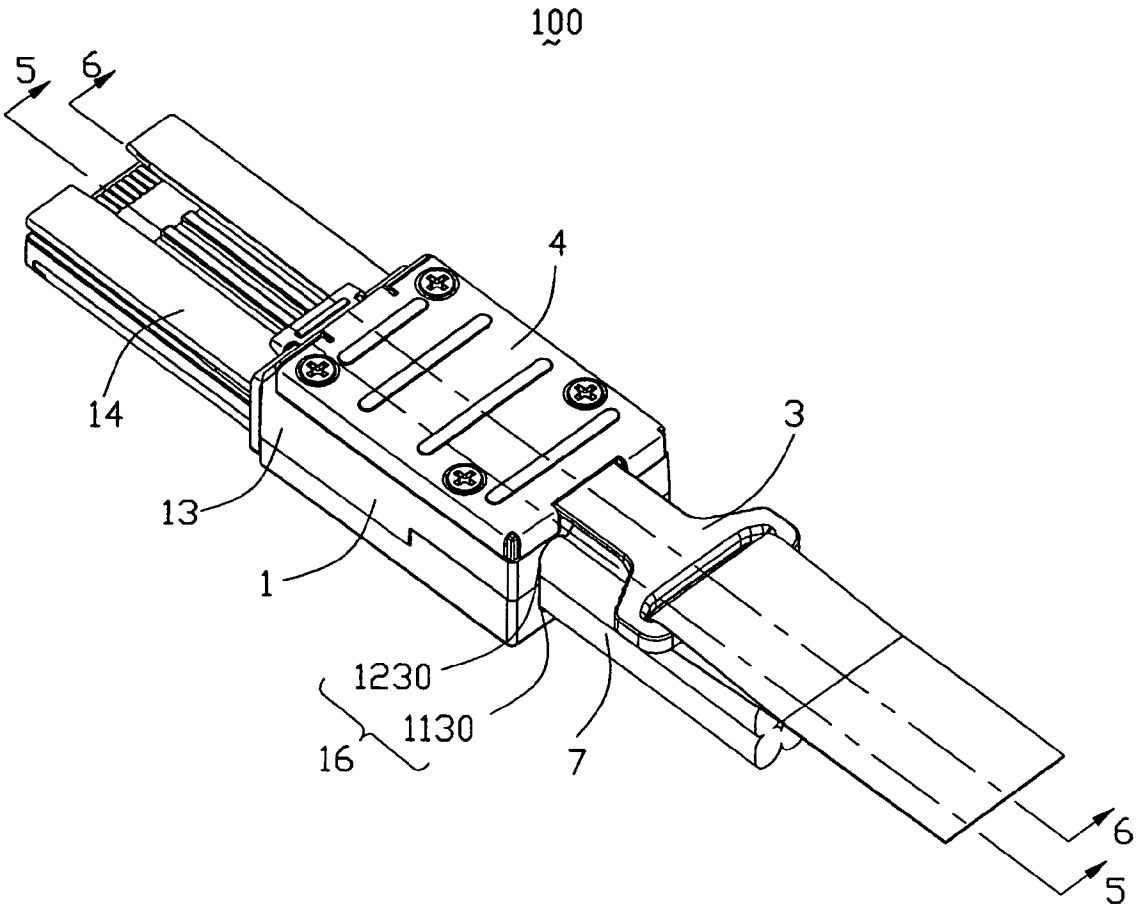
FIG. 4 is a view similar to FIG. 3, but viewed from a different aspect.

Referring to FIGS. 1-3, a plug connector 100 in accordance with the present invention comprises a housing 1, a circuit card 2 located in the housing 1, a cable set 7 comprising a plurality of cables 71 respectively electrically connecting with the circuit card 2, a latch mechanism 3 assembled to the housing 1, a metal shell 4 assembled to the housing 1 to partially cover the latch mechanism 3, and a strain relief member 8 electrically connecting with the cables 71.

Figure 5:
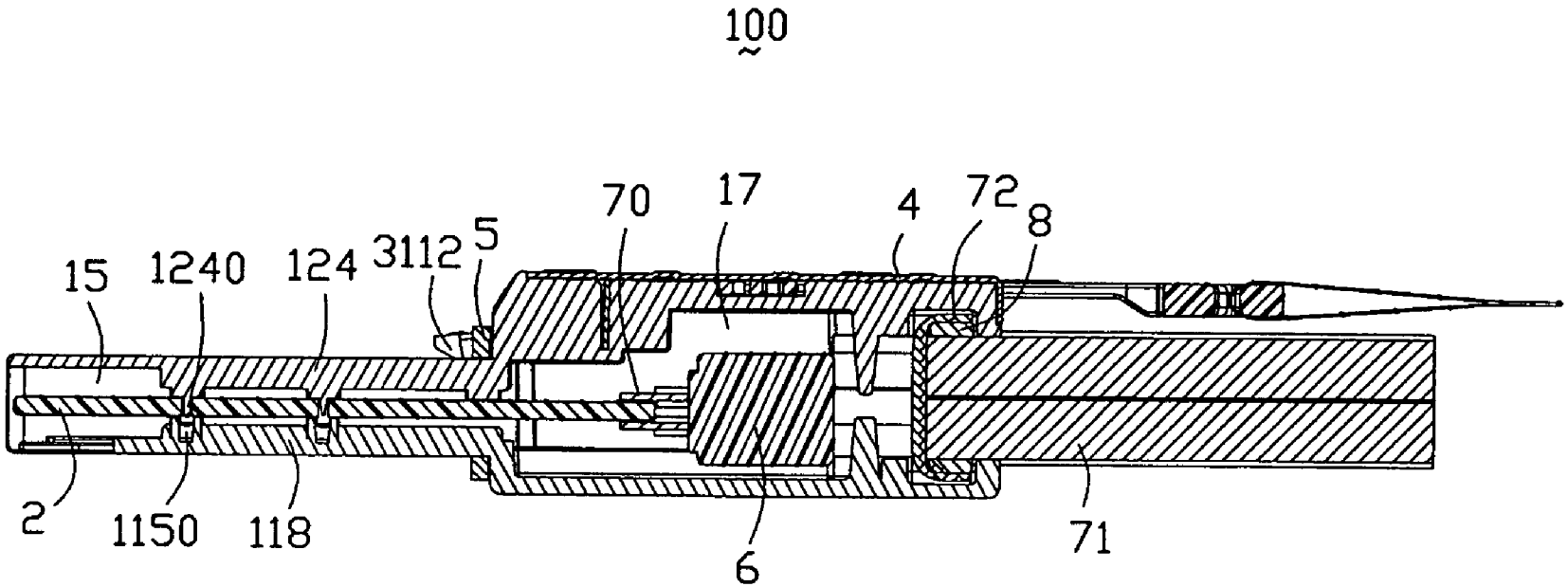
FIGS. 5-8 are cross-section views taken along lines 5-5 to 8-8 of FIGS. 3 and 4.

Please refer to FIGS. 1-2, the housing 1 of the present invention is made of metal material and comprises a base 11, a cover 12 engagble with the base 11 and a receiving space 15 (FIG. 5) formed between the base and the cover 11, 12. The metal housing 1 also comprises a rectangular base portion 13 and an elongated tongue portion 14 extending forwardly from the base portion 13.

The base 11 comprises a first base section 11*a* and a first tongue section 11*b* extending forwardly from the first base section 11*a*. The first base section 11*a* comprises a first flat portion 110, a pair of first flanges 112 and a thicker first rear wall 113 respectively extending upwardly from opposite side edges and rear edge of the first flat portion 110. A pair of posts 1134 are respectively formed with the first flanges 112 and each defines a first screw hole 1136. A first receiving channel 1132 is formed between the first rear wall 113 and the pair of posts 1134. A waved first exiting opening 1130 is defined in the first rear wall 113 to communicate with the outside and the first receiving channel 1132.

The first tongue section 11*b* comprises a first panel 118 formed with a pair of ribs 114 located at opposite sides thereof. Each rib 114 forms a tip end 1140 extending beyond a front edge of the flat portion 118. The first panel 118 also forms two pairs of first standoffs 115 spaced arranged thereon, and each first standoff 115 defines a first positioning hole 1150 therein. A pair of U-shape cutouts 117 extend rearward from the front edge of the first panel 118 and respectively locate adjacent to corresponding tip ends 1140.

The cover 12 comprises a second base section 12*a* and a second tongue section 12*b* extending forwardly from the second base section 12*a*. The second base section 12*a* comprises a second flat portion 120, a pair of second flanges 122 and a second rear wall 123 extending downwardly from opposite side edges and a rear edge of the second flat portion 120. A pair of second posts 1234 are respectively formed with the second flanges 122 and each defines a second screw hole 1236. A second receiving channel 1232 is formed between the posts 1234 and the second rear wall 123. A waved second exiting opening 1230 is defined in the second rear wall 123 to communicate with the outside and the second receiving channel 1232.

The second flat portion 120 defines a first recess section 127 consisting of different-size first and second recesses 1270, 1272, and a deeper and narrower second recess section 128 formed in a front portion of the second flat portion 120 to communicate with a front surface of the second flat portion 120. A deeper slit 1280 is defined in the front portion of the second flat portion 120 and extends in a direction perpendicular to that of the second recess section 128 to communicate with the second recess section 128. A pair of projections 1284 are arranged on front end of the second recess section 128. The upper portions of the outer periphery of the second flanges 122 and the second rear wall 123 are partially cut to form recess. In addition, the second flat portion 120 forms a plurality of steps 121 extending downwardly therefrom with different height. Another pair of second screw holes 1232 is recessed downwardly from the top surface of the second base section 12*a* a certain depth and locate at opposite sides of the second recess section 128.

The second tongue section 12*b* comprises a second panel 124 and a pair of side walls 125 extending downwardly from opposite sides of the second panel 124. The middle section of the second panel 124 is cut partially and is slotted with a plurality of keyways 1244. A pair of second channels 1250 are defined in corresponding side walls 125 opened toward outside for guiding the insertion of the plug connector 100 and positioning the plug connector 100 relative to a complementary connector (not shown) together with the keyways 1244. A pair of protrusions 126 extend rearward from a front surface of the second tongue section 12*b* and respectively locate below the side walls 125 to form a pair of gaps 1260 therebetween. The second panel 124 forms an enhancing portion (not labeled) on a bottom surface thereof for enhancing the strength thereof and three pairs of second standoffs 1240 are symmetrically arranged on the enhancing portion with two pairs of second standoffs 1240 formed with posts 1242 extending downwardly.

The circuit card 2 is formed with a plurality of first conductive pads 21 aligned at a front end thereof and a plurality of second conductive pads 22 aligned at an opposite rear end thereof with different amount from that of the first conductive pads 21. The first and second conductive pads 21, 22 electrically connect with one another through inner traces disposed in the circuit card 2. Two pairs of holes 23 are symmetrically arranged on the circuit card 2 adjacent to the first conductive pads 21.

The latch mechanism 3 comprises a latch member 31 latching with the complementary connector, a pulling member 32 cooperating with the latch member 31 to actuate the latch member 31 to unlatch from the complementary connector, and an elective pull tape 33 assembled to the pulling member 32.

Particularly referring to FIG. 3, the latch member 31 is made of metal material and is a cantilever-type member. The latch member 31 comprises an N-shape engaging portion 310 located in a vertical surface, a flat latching portion 311 located in a horizontal surface perpendicular to the vertical surface and an inclined actuation section 312 connecting the engaging portion 310 with the latching portion 311 to provide spring force to the latch member 31. The engaging portion 310 comprises a transverse bar section 3101 and a pair of side sections 3102 extending downwardly from opposite sides of the bar section 3101. Each side section 3102 is formed with barbs 3104 on outmost edge thereof. The flat latching portion 311 defines a pair of rectangular holes 3110 at a rear portion thereof adjacent to the actuation section 312 and a pair of latches 3112 bending downwardly from opposite sides of the front edge thereof. The actuation section 312 connects with middle portion of the bar section 3101 and extends upwardly from a lower edge of the bar section 3101. The actuation section 312 also defines a hole therein for adjusting spring force of the latch member 31 through changing size and shape of the hole. Each of the side section 3102 and the latching portion 310 is formed with a rib stamped therewith for respectively enhancing the engagement with the housing 1 and the complementary connector.

The pulling member 32 is made by insulative material and comprises a front cooperating portion 321, an elongated intermediate portion 323 extending rearward form the cooperating portion 321 and formed with an interference portion 322, and an operating portion 324 formed at a rear end of the intermediate portion 323. The interference portion 322 comprises a pair of stop sections 3222 formed at opposite sides of the intermediate portion 323 and located adjacent to the cooperating portion 321 and a pair of elastic sections 3220 formed at middle portion of the intermediate portion 323. Each elastic section 3220 comprises a transverse block section 3224 and a V-shape claw section 3226 extending rearward from the block section 3224. The cooperating portion 321 comprises a vertical section 3210 connecting the cooperating portion 321 with the intermediate portion 323 and a body section 3212 extending forwardly from a lower edge of the vertical section 3210. The body section 3212 forms a pair of upwardly extending ribs 3214 with tip end formed with enlarged protrusions 3216. A slanted surface 3218 downwardly and rearward extends from a front surface of the body section 3212. The operating portion 324 is enlarged from the intermediate portion 323 and thus, forms a pair of slanted edges for facilitating handle. The operating portion 324 also defines a rectangular slot 3242 in a main portion thereof to cooperate with the pull tape 33.

The pull tape 33 is a piece of belt with opposite ends sticked to each other to form a loop portion 330 and a rear pull portion 332. The pull tape 33 firstly protrudes through the slot 3242 of the operating portion 324 of the pulling member 32 and then sticks the opposite ends together.

The conductive shell 4 comprises a body portion 40 formed with a plurality of bars on a top surface for increasing friction and a pair of lateral walls 42 extending downwardly from opposite sides of the body portion 40. Two pairs of holes are respectively formed at front portion and rear portion of the body portion 40. A downwardly-extending first tab 404 is formed at a front edge of the body portion 40. A pair of second tabs 405 are formed with the body portion 40 extending downwardly from a rear edge of the body portion 40.

The cable set 7 comprises four standard Serial ATA cable 71 juxtaposed arranged with outer jackets molded together. Each Serial ATA cable 71 comprises a pair of groups surrounded by the jacket. Each group comprises a pair of signal conductors 73 each surrounded by an insulator and a metal braiding layer 72, and a pair of grounding conductors 74 located adjacent to the pair of signal conductors 73 and electrically connecting with the metal braiding layer 72. The front jacket of the cable set 7 is stripped and the metal braiding layers 72 of the cables 71 are shaped into a cap to define a space 720 facing rear end of the cable set 7. Further, the insulators of the cables 71 are stripped to expose the front ends of the signal and grounding conductors 73, 74. In addition, the spacer 6 is made by insulative material and defines a plurality of through holes permitting the extrusion of the cables 71 to align the conductors 73, 74 for facilitating the solder between the cables 71 and the circuit card 2.

The strain relief member 8 is die cast from metal material with certain thickness. The strain relief member 8 defines a hollow space 80 therein with waved edges for permitting the exit of the cables 71. The strain relief member 8 is received in the space 720 formed by the metal braiding layer 72 with the cables 71 extending through the hollow space 80. The metal braiding layer 72 is soldered with the outer surface of the strain relief member 8.

Figure 6:
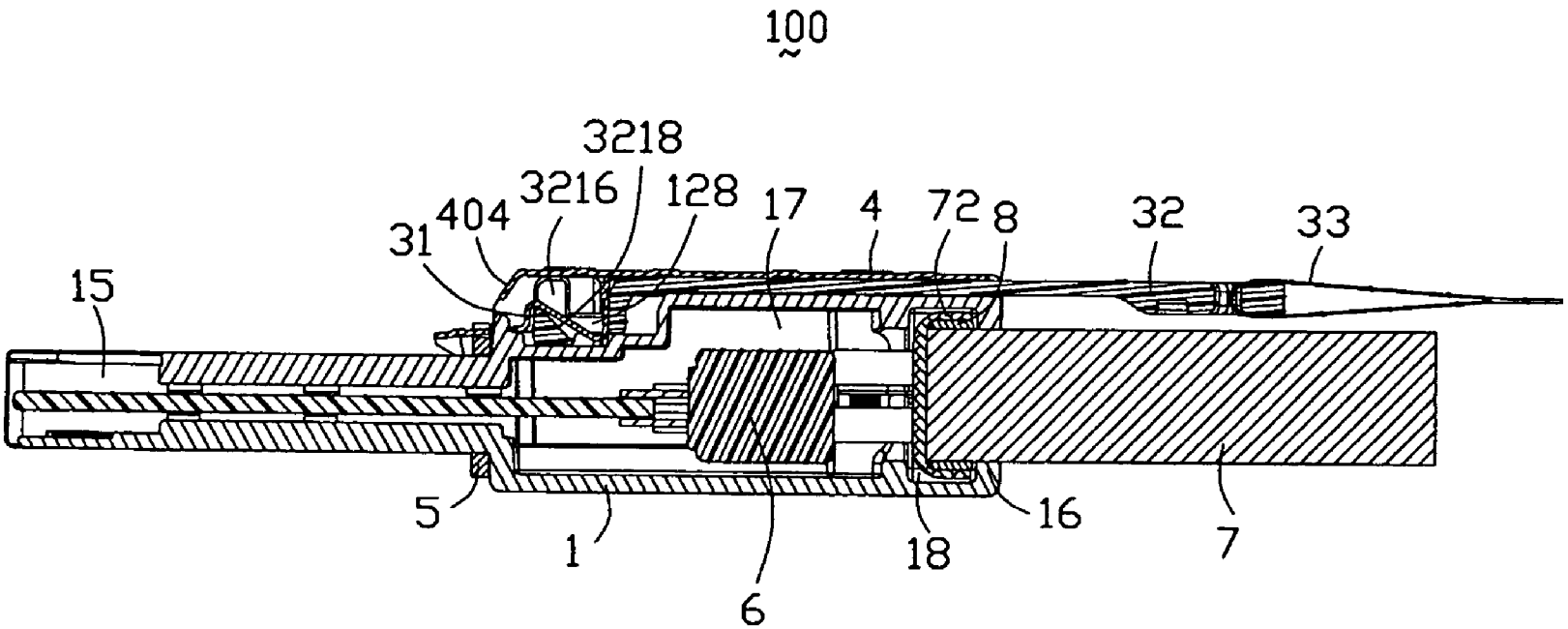
Figure 7:
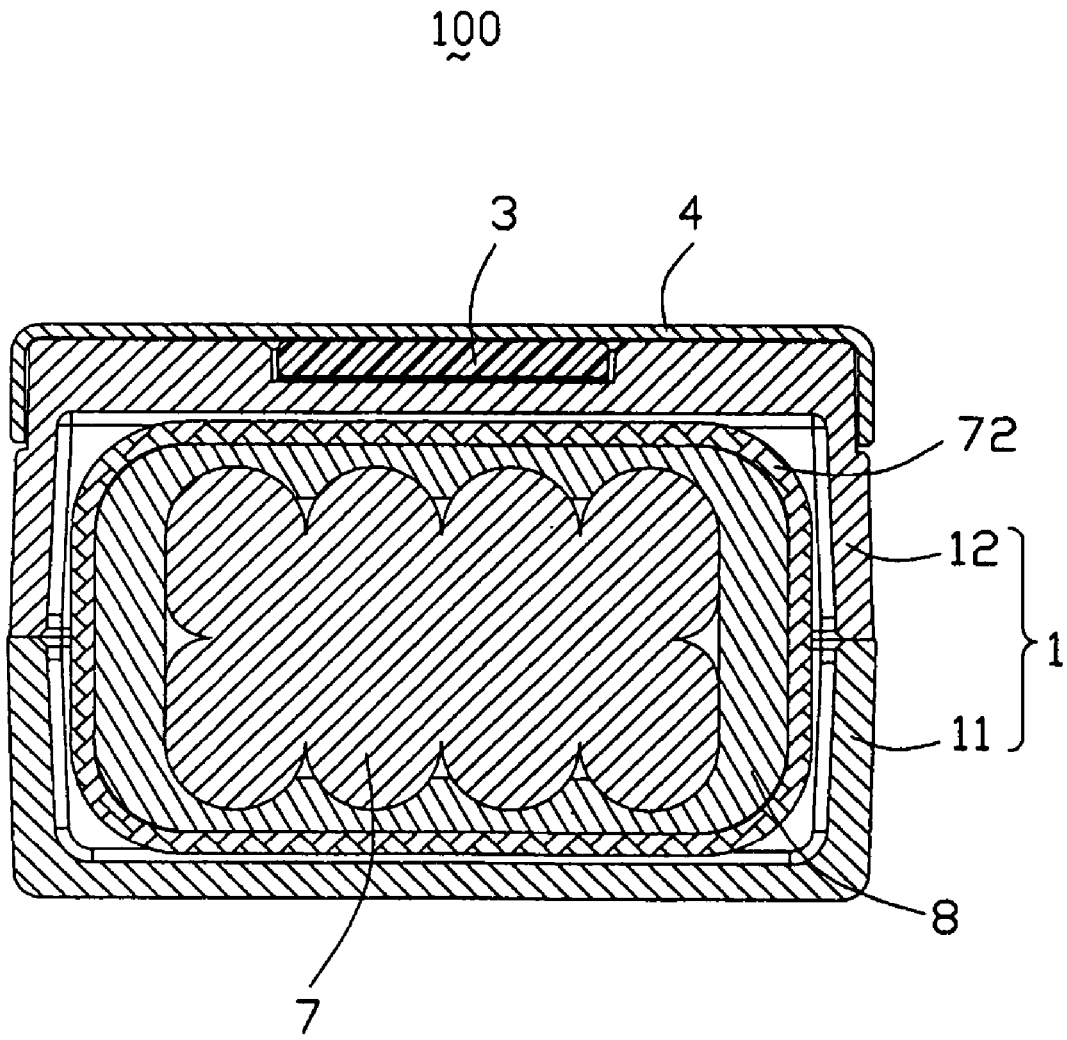
Figure 8:
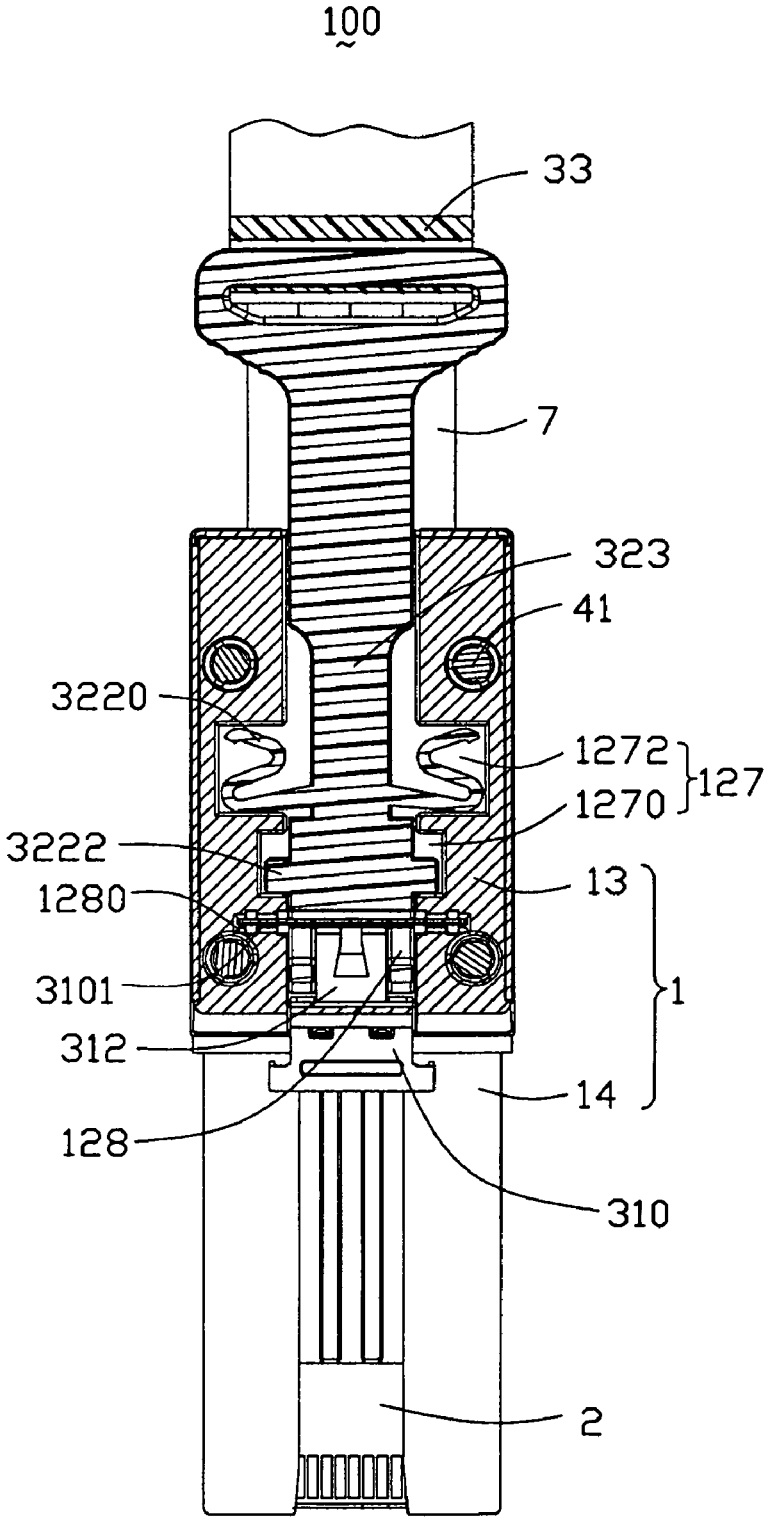

In assembly, the conductors 73, 74 aligned by the spacer 6 are respectively soldered to the second conductive pads 22 of the circuit card 2. The spacer 6 is received in the receiving space 17 (FIG. 5) formed by the first base section 11*a* and the second base section 12*a*. The strain relief member 8 soldered with the metal braiding layer 72 of the cables 71 is received in the first receiving channel 1132 of the base 11 and stopped by the rear wall 113 when the cable set 7 is pulled. The circuit card 2 with the cables 71 is located on the first standoffs 115 of the base 11 with the holes 23 aligned with the first positioning holes 1150 and the cables 71 are exited from the exiting opening 1130 of the base 11. The cover 12 is assembled to the base 11 and the circuit card 2 with the posts 1242 protruding through the holes 23 and the first positioning holes 1150 to position the circuit card 2 in the receiving space 15 of the housing 1. The circuit card 2 is sandwiched between the base 1 and the cover 12. The pair of tip ends 1140 are received in the gaps 1260, thus, the base 11 and the cover 12 are also securely assembled together. The first and second screw holes 1132, 1232 combine into a screw receiving space (not labeled). The first and the second exiting openings 1130, 1132 together define an exiting opening to let the cable set 7 exit from the housing 1. The first and second receiving channels 1132, 1232 together define a receiving channel 18 (FIG. 6) to receive the strain relief member 8 therein and provide stop to the strain relief member 8.

Referring to FIGS. 2-8, the latch mechanism 3 is assembled to the second base section 12*a* of the cover 12 along a vertical direction perpendicular to the front-to-back direction. The pulling member 32 is firstly pressed to the cover 12. The cooperating portion 321 of the pulling member 32 is received in the second recess section 128 of the cover 12, and the intermediate portion 323 with the interference portion 322 are received in the first recess section 127. The stop sections 3222 and the elastic sections 3220 are respectively sliderably received in the different-size first and second recesses 1270, 1272 with the block section 3224 and claw section 3226 respectively abutting against opposite edges of the large-size second recesses 1272. The latch member 31 is assembled to the cover 12 along the vertical direction and the engaging portion 310 is interferentially received in the slit 1280 by the barbs 3104 of the side sections 3102. The inclined actuation section 312 is located on the slanted surface 3218 of the body section 3212 of the cooperating portion 321. The bar section 3101 of the latch member 31 are located on the ribs 3214 with the enlarged protrusions 3216 located in front of the bar section 3101. The projections 1284 of the cover 12 are respectively received in the rectangular holes 3110 and the latches 3112 exposed above the second tongue section 12*b*.

When the complementary connector mates with the plug connector 100 of the present invention, contacts of the complementary connector may electrically connect with the first conductive pads 21 of the circuit card 2 with corresponding structure thereof latches with the latches 3112 of the latch member 31. When the plug connector 100 disengages from the complementary connector, a rearward pulling force exerts to the operating portion 324 of the pulling member 31 or the pull section 332 of the pull tape 33, according to the space left for the operator to operate, to actuate the pulling member 32 rearward move with the elastic sections 3220 and the stop sections 3222 sliding in the second and first recesses 1272, 1270 until the enlarged protrusions 3216 abut against the bar section 3101 of the latch member 31. The body section 3212 also rearward moves with the slanted surface 3218 sliding along a bottom periphery of the inclined actuation section 312, thus actuating the actuation section 312 to pivot upwardly relative to the bar section 3101 of the engaging portion 310 and the latch section 311 with the latches 3112 to upwardly move to unlatch from the complementary connector. After the rearward pulling force is removed, restore force of the elastic sections 3220 actuates the pulling member 32 to move forwardly to its original position, and thus, the latch member 31 also reverts to its original position. That is to say, when the space left for the operator is large enough, the operator may pull the pulling member 32 or the pull tape 33 to drive the latch member 31 to unlatch from the complementary connector; when the space left for the operator is small, the operator may pull the pull tape 33 to separate the plug connector 100 from the complementary connector.

The conductive shell 4 is finally assembled to the second base section 12*a* of the cover 12 with the lateral walls 42 and the second tabs 405 respectively received in the recess formed by the second flanges 122 and the second rear wall 123. The first tab 404 is received in the second recess section 128 of the cover 12. The first tab 404 also presses on the latch member 31 to provide extra return force to the latch member 31 when disengaging the plug connector 100 from the complementary connector. Two pairs of screws 41 are screwed through the shell 4, the second screw holes 1232 of the cover 12 and the first screw holes 1132 of the base 11 to retain the shell 4 with the base 11 and the cover 12, The plug connector 100 of the present invention is equipped with an EMI gasket 5 assembled to the metal housing 1 for reducing the Electro Magnetic Interference (EMI) in the signal transmission. The gasket 5 is a rectangular frame and stamped from a metal sheet.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector comprising:

a metal housing defining a receiving channel in a rear portion thereof and an exiting opening communicating with the receiving channel and the rear surface of the metal housing;

a plurality of conductive contacts located in the metal housing;

a cable set exiting from the exiting opening of the metal housing and comprising a plurality of conductors electrically connecting with the conductive contacts, a metal braiding layer shielding the conductors and partially exposed in the receiving channel, and an outer jacket surrounding the metal braiding layer, and a strain relief member assembled to the cable set to locate between the outer jacket and the metal braiding layer of the cable set, and thus, the metal braiding layer and the strain relief member being received in the receiving channel and the metal braiding layer contacting the metal housing; and a printed circuit board (PCB) received in the housing; wherein the contacts are first and second conductive pads formed at front and rear ends of the PCB.

2. The plug connector as claimed in claim 1, wherein the strain relief member is a close member and comprises a hollow space having same periphery shape as that of the cable set.

3. The plug connector as claimed in claim 1, the cable set comprises at least two cables juxtaposed arranged, and wherein each cable is according to Serial ATA standard.

4. The plug connector as claimed in claim 1, wherein the metal braiding layer is shaped to surround outer periphery of the strain relief member.

5. The plug connector as claimed in claim 4, wherein the metal braiding layer is soldered to the outer periphery of the strain relief member.

6. The plug connector as claimed in claim 1, further comprising a transversely moveable latch member located on an exterior side of the metal housing, a pulling member associated with a rear portion of the latch member for transversely actuating the latch member, and a pull tape associated with a rear portion of the pulling member for selectively grasped.

7. The plug connector as claimed in claim 6, wherein the pulling member is stiff and the pull tap is soft.

8. The plug connector as claimed in claim 6, wherein the operating portion of the pulling member is exposed beyond the base portion of the housing and the pull tape is wholly exposed beyond the base portion of the housing.

9. The plug connector as claimed in claim 6, further comprising a conductive shell assembled to the housing to partially shield the latch member and the pulling member.

10. The plug connector as claimed in claim 6, wherein the pulling member is moveable relative to the housing in a horizontal direction and comprises a front cooperating portion and a rear operating portion.

11. The plug connector as claimed in claim 10, wherein the latch member is vertically planted into a top surface of the base portion and the latching portion thereof partially extends beyond a front surface of the base portion to locate above the tongue portion.

12. The plug connector as claimed in claim 10, wherein the latch member is discrete from the pulling member and is assembled to the housing for latching with a complementary connector, and wherein the latch member comprises an engaging portion assembled to the housing, an actuation section extending from the engaging section and capable of being actuated by the cooperating portion of the pulling member, and a front latching portion extending forwardly from at least one of the engaging portion and the actuation section for latching to the complementary connector.

13. The plug connector as claimed in claim 12, wherein the engaging portion of the latch member locates in a vertical surface and the latching member locates in a horizontal surface, and wherein the housing comprises a base portion and a tongue portion extending from the base portion, the base portion defines a slit vertically extending a certain distance from a top surface thereof to receive the engaging portion of the latch member.

14. The plug connector as claimed in claim 12, wherein engaging portion is of n-shape and comprises a bar section from which the actuation section extends and a pair of side portions formed with barbs to interferentially engage with the slit.

15. The plug connector as claimed in claim 12, wherein the cooperating portion of the pulling member forms a slanted surface located below the actuation section of the latch member and capable of sliding along the actuation section to actuate the latching portion pivotally move relative to the engaging portion to separate from the complementary connector.

16. A plug connector comprising:

a metal housing defining a receiving channel in a rear portion thereof;

a plurality of conductive contacts located in the metal housing;

a cable set comprising plurality of cables juxtaposed arranged and each cable comprising at least one conductor electrically connecting wit the conductive contacts, a metal braiding layer shielding the conductor with thereof a front portion exposed in the receiving channel, and an outer jacket surrounding the metal braiding layer; and wherein the metal braiding layers of the cables together being formed into one integral metal braiding layer; and a strain relief member assembled to the cable set to locate between the outer jackets of the cables and the integral metal braiding layer of the cables of the cable set, and thus, the integral metal braiding layer and the strain relief member being received in the receiving channel and the metal braiding layer contacting the metal housing.

17. The plug connector as claimed in claim 16, wherein the strain relief member is made of metal, and the integral metal braiding layer is directly fixed to said strain relief member.

18. The plug connector as claimed in claim 16, wherein each cable are a standard Serial ATA cable.

19. The plug connector as claimed in claim 16, wherein the metal braiding layer is shaped to surround outer periphery of the strain relief member, and wherein the metal braiding layer is soldered to the outer periphery of the strain relief member.

20. A plug connector comprising:

a metal housing defining a receiving channel in a rear portion;

a plurality of conductive contacts located in the metal housing;

a cable set comprising a plurality of conductors electrically connecting with the conductive contacts, said conductors being enclosed in an outer insulative outer jacket, a metal braiding layer shielding the conductors with a front portion exposed into the receiving channel of the housings and an outer jacket surrounding the metal braiding layer; and a metallic strain relief member assembled to the cable and fixed to the metal braiding layer and received in the receiving channel, wherein at least one of said strain relief member and said braiding layer directly mechanically and electrically contacts the metal housing;

a printed circuit board (PCB) received in the housing; wherein the contacts are first and second conductive pads formed at front and rear ends of the PCB.

* * * * *